United States Patent [19]

Schregenberger

[11] 4,162,955

[45] Jul. 31, 1979

[54] ELECTRODEPOSITION COATING APPARATUS

[75] Inventor: Alex J. Schregenberger, Neshanic, N.J.

[73] Assignee: Midland-Ross Corporation, Cleveland, Ohio

[21] Appl. No.: 949,873

[22] Filed: Oct. 10, 1978

[51] Int. Cl.[2] ..... C25D 17/02; C25D 13/16

[52] U.S. Cl. ..... 204/299 EC; 204/181 C; 204/202; 204/234; 204/237; 118/314; 118/620; 118/627

[58] Field of Search ..... 204/181 EC, 299 EC, 204/300 EC, 202, 237, 234; 118/300, 314, 620, 627, 630

[56] References Cited

U.S. PATENT DOCUMENTS

| | | | |
|---|---|---|---|
| 2,041,765 | 5/1936 | Howell | 118/314 X |
| 2,854,946 | 10/1958 | Norris | 118/314 X |
| 3,000,752 | 9/1961 | Jackson et al. | 118/627 X |
| 3,068,836 | 12/1962 | Spencer | 118/314 X |
| 3,492,213 | 1/1970 | Johnson | 204/181 EC |
| 3,565,683 | 2/1971 | Morelock | 118/620 X |
| 4,119,522 | 10/1978 | Brower, Jr. et al. | 204/300 EC |

*Primary Examiner*—Arthur C. Prescott
*Attorney, Agent, or Firm*—Harlan E. Hummer

[57] ABSTRACT

An apparatus used in the electrodeposition coating of a continuous sheet of metal as it travels in a horizontal pathway between a pair of electrically charged electrodes and through a bath of liquid coating solution that is continuously circulated to the bath through a pair of liquid seals which are disposed adjacent opposing, aligned openings through which the sheet of metal enters and exits a chamber containing the bath. The liquid seals are each comprised of a pair of nozzles for directing converging streams of liquid coating solution against the traveling sheet of metal in the direction of the chamber and have a three-fold purpose. They are designed to, (I) prevent the escape of liquid coating solution from the chamber through the openings, (II) provide a liquid support for the sheet of metal at the openings in the opposing end walls of the chamber, and (III) direct fresh liquid coating solution along the sheet of metal into the critical area or space between the electrodes to maintain and keep uniform in this area, the concentration of the liquid coating solution that becomes diluted as the coating material of the solution adheres to the sheet of metal during its travel between the electrodes. A pair of blow off nozzles are supplied adjacent and outside each of the liquid seals to direct air, under pressure, angularly against the sheet of metal in the direction of the chamber to aid in the prevention of the escape of liquid coating solution from the apparatus, to provide an additional fluid bed for supporting the sheet of metal and to minimize and control the thin film of liquid coating material which adheres by surface tension to the sheet of metal.

18 Claims, 4 Drawing Figures

ELECTRODEPOSITION COATING APPARATUS

BACKGROUND OF THE INVENTION

The invention broadly relates to the coating of a continuous element or web, and especially to the electrodeposition coating of a continuous sheet of metal that travels in a generally horizontal pathway through a coating apparatus.

There are presently on the market coating apparatuses which utilize rollers for supporting a sheet of metal as it travels horizontally through a bath of liquid coating solution. It has been found that the roller immediately downstream from the liquid bath can cause distortion of the undried liquid coating which adheres to the sheet of metal. Some apparatuses eliminate the use of a downstream roller by passing the sheet of metal vertically through a bath of liquid coating directly into an overhead oven, wherein the liquid coating is baked or dried onto the sheet of metal. However, such apparatuses require overly tall buildings for housing them.

U.S. Pat. No. 3,962,060 is directed to a coating apparatus which eliminates the need for rollers to support a sheet of metal traveling in a horizontal pathway. The particular apparatus shown and described in this patent utilizes successive jets of liquid coating solution as a means for supporting the sheet of metal as it travels through a bath of liquid coating solution. These jets of liquid coating solution are impinged directly against the traveling metal sheet at angles of substantially 90° relative to the plane of the metal sheet. The velocity at which these jets of liquid strike the sheet of metal must be carefully controlled. Otherwise, the coating material will foam excessively and adversely affect the coating being applied to the sheet of metal. The particular coating apparatus of this patent also uses at the entrance and exit openings through which the sheet of metal enters and exits the bath of coating solution, ordinary flap seals which have proven to be unsatisfactory over extended periods of time, since the traveling sheet of metal, especially the generally ragged overlapped ends and edges of two spliced sheets of metal, gradually destroys the seals to allow the mass escape of liquid coating solution from the apparatus, such escape having a ruinous affect upon the appearance of the coating. The invention is directed to an improved apparatus which eliminates or substantially reduces some of the aforementioned problems experienced with prior art electrodeposition coating devices for coating a continuous sheet of metal.

Briefly stated, the invention is in an electrodeposition coating apparatus having a tank with a horizontally elongated treatment chamber that is provided with a pair of longitudinally spaced end walls with horizontally aligned openings through which a continuous traveling web, such as a sheet of metal, enters and exits the chamber and bath of liquid coating solution contained therein. A pair of parallel, electrically charged electrodes are disposed longitudinally in the chamber and are positioned to sandwich the traveling web therebetween. A liquid seal is provided adjacent each of the openings through which the traveling web enters and exits the chamber. Each of the liquid seals includes a pair of parallel, elongated nozzles which are disposed normal to the direction in which the web travels. The nozzles are at least coextensive with the openings and have at least one continuous slot facing the traveling web. Means are supplied for circulating liquid coating solution, under pressure, into the nozzles and uniformly out through the slots. A deflector is provided adjacent each of the slots to direct a steady flow of liquid coating solution angularly against the traveling web at an angle substantially less than 90° to the plane of the web and in the direction of the chamber and into the space between the electrodes. The turbulent flow of liquid coating solution acts to support the traveling web and eliminates the need for a downstream roller, prevent the escape of liquid coating solution from the apparatus, and maintain the proper concentration of the liquid coating solution in the critical area between the electrodes.

Other aspects of the invention are the provision of means for supplying liquid coating solution to the chamber at a level which is vertically lower than the electrodes, and for continuously circulating liquid coating material into the chamber to a level where the electrodes are submerged in the liquid coating solution. Means are also disposed adjacent opposing surfaces of the traveling web outside the chamber and beyond the liquid seals, for directing air, under pressure, angularly against the traveling web in the direction of the liquid seals and chamber to help prevent the escape of liquid coating solution, to aid in the support of the traveling web, and to minimize and control drag-out of the liquid coating material on the traveling web, i.e. the thin film of liquid coating material that adheres by surface tension to a traveling web such as a sheet of metal.

DESCRIPTION OF THE DRAWING

The following description of the invention will be better understood by having reference to the accompanying drawing, wherein.

DESCRIPTION OF THE INVENTION

Figure 1:
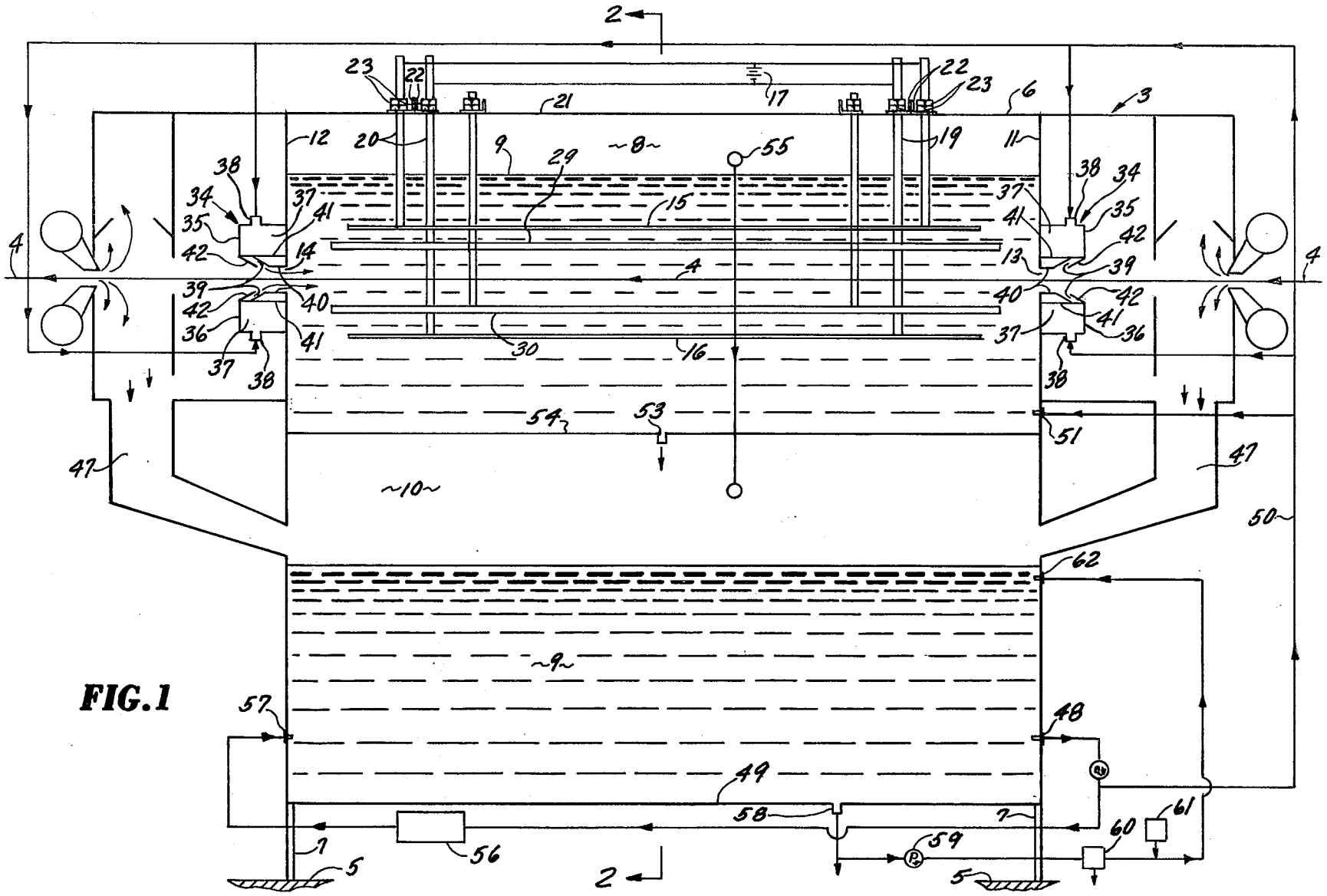
FIG. 1 is a section of an electrodeposition coating apparatus which is made in accordance with the invention, as viewed from the line 1—1 of FIG. 2, with certain controls for the apparatus being shown schematically.
Figure 2:
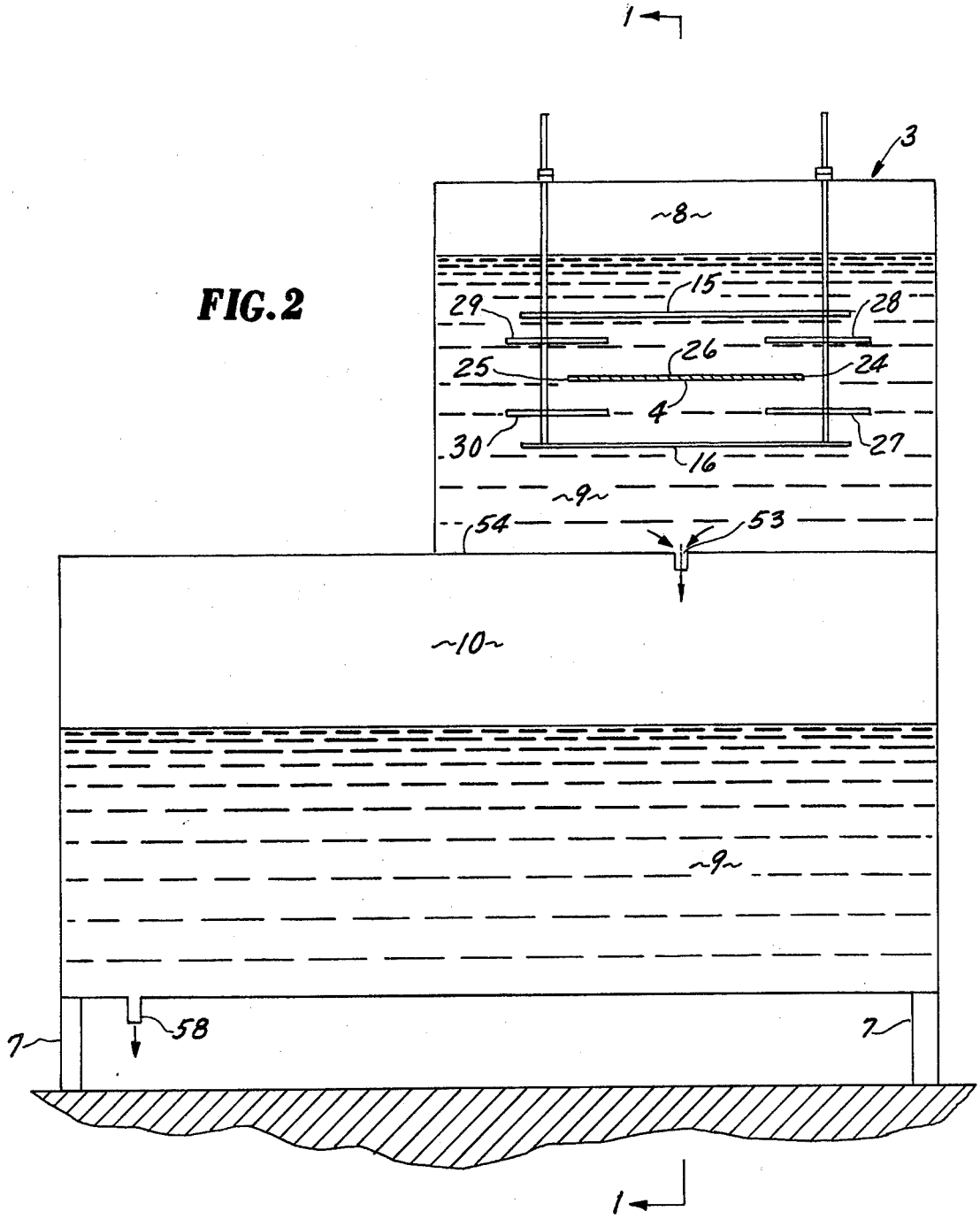
FIG. 2 is a section of the apparatus, as viewed from the line 2—2 of FIG. 1.

With reference to FIGS. 1 and 2, there is shown an apparatus 3 which is designed for use in the electrodeposition coating of a continuous element or web, such as a sheet 4 of metal, as it travels along a generally horizontal pathway through the apparatus 3 when the apparatus 3 is resting on a generally horizontal surface 5. The coating apparatus 3 comprises a tank 6 which is supported in spaced relation from the surface 5 by a plurality of similar legs 7. The tank 6 has a horizontally elongated treatment chamber 8 for holding a bath of liquid coating solution 9 which contains a desired coating material, e.g. resinous paint particles, for electrodeposition coating on the metal sheet 4 as it travels through the liquid coating solution 9. The treatment chamber 8 is vertically above a separate reserve chamber 10 which is also designed to hold a supply of liquid coating solution 9. The treatment chamber 8 has a pair of longitudinally spaced opposing end walls 11,12 with horizontally aligned and laterally elongated openings 13,14 through which the traveling metal sheet 4 enters and exits the treatment chamber 8 and bath of liquid coating solution 9 contained therein.

A pair of vertically spaced, parallel electrodes 15,16 are disposed horizontally in the treatment chamber 8 and are positioned relative to the openings 13,14 in the end walls 11,12 to sandwich the metal sheet 4 therebetween as it travels horizontally through the treatment chamber 8. The electrodes 15,16 are in electrical communication with any suitable source of electricity, e.g. battery 17, for supplying the necessary electrical current to the electrodes 15,16, as described in U.S. Pat. No. 3,962,060. The metal sheet 4 is grounded by any appropriate means, e.g. ground roller 18 (FIG. 4) also described in U.S. Pat. No. 3,962,060.

The vertical positions of the electrodes 15,16 within the treatment chamber 8, relative to the generally fixed pathway which the metal sheet 6 travels through the treatment chamber 8, are adjustable by any suitable means. For example, the electrodes 15,16 are each secured to a plurality of parallel, threaded rods 19,20 which extend upwardly through the top 21 of the tank 6 and through similarly slotted reinforcement steel angles 22 that extend laterally across the treatment chamber 8. Conventional nuts 23 are used to threadably engage the rods 19,20 and coact with the steel angles 22 to suspend the electrodes 15,16 in a number of vertical positions within the treatment chamber 8 and, depending on the length of the slots in the steel angles 22, slightly vary the lateral positions of the electrodes 15,16 relative to the traveling metal sheet 4. The size, i.e. length and width of the electrodes 15,16, and distance of the electrodes 15,16 from the traveling metal sheet 4 can be varied depending on the liquid coating solution 9 being used and the thickness of the coating desired to be deposited on the metal sheet 4.

It was found that certain liquid coating solutions caused an excessive build-up of coating material deposited at the longitudinal marginal edges 24,25 of the traveling metal sheet 4, as compared to the coating material deposited on the sheet portion 26 intermediate the marginal edges 24,25. The excessive coating along the marginal edges 24,25 is controlled by suspending a plurality of edge guards 27–30 between the marginal edges 24,25 of the metal sheet 4 and adjacent electrodes 15,16 so that the edge guards 27–30 at least partially cover the marginal edges 24,25. The use of the edge guards 27–30 produces a more uniform coating laterally across the traveling metal sheet 4. The edge guards 27–30 are composed of any suitable electrically nonconductive material such as plastic, e.g. polypropylene or polyvinyl chloride. The flat edge guards 27–30 of FIGS. 1 and 2, must be sufficiently strong and rigid to remain straight and parallel to the traveling metal sheet 4.

Figure 3:
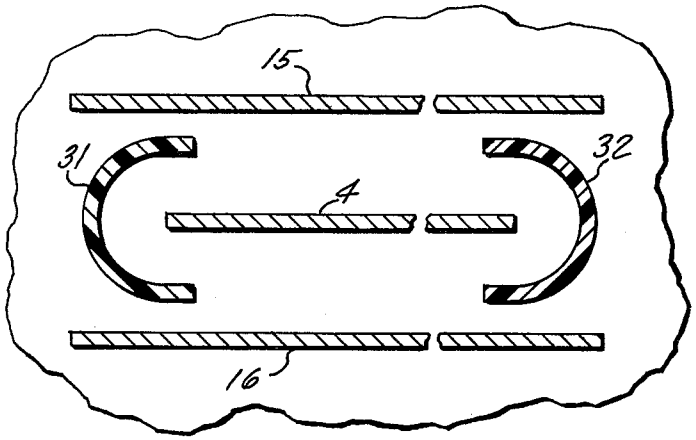
FIG. 3 is a section of a portion of the apparatus designed to illustrate a different embodiment of edge guards used in regulating the build-up of coating material adjacent the longitudinal marginal edges of a sheet of metal during the coating process.

With reference to FIG. 3, there is shown a pair of plastic, semi-cylindrical edge guards 31,32 which are suspended between the electrodes 15,16, so that they at least partially surround the adjacent marginal edges 24,25 of the traveling metal sheet 4. It was discovered that the semi-cylindrical edge guards 31,32 are more effective in controlling excessive coating along the marginal edges 24,25 and produce a more uniform coating on the traveling metal sheet 4 than the flat edge guards 27–30. The edge guards 27–32, whether flat or curved, are similarly mounted like the electrodes 15,16, by threaded rods, angles and nuts for vertical and lateral movement within the treatment chamber 8.

A pair of similar liquid seals 34 are disposed adjacent the openings 13,14 of the end walls 11,12 to prevent the escape of liquid coating solution 9 from the treatment chamber 8 through the openings 13,14. The liquid seals 34 are each comprised of a pair of parallel nozzles 35,36 for directing converging streams of liquid coating solution 9, under pressure, towards the treatment chamber 8 and against the traveling metal sheet 4 and liquid coating solution 9 attempting to escape from the chamber 8 through the openings 13,14 in the end walls 11,12. The nozzles 35,36 extend longitudinally of the openings 13,14 and transversely to the direction in which the metal sheet 4 travels as it enters and exits the treatment chamber 8. The nozzles 35,36 each comprise an enclosed longitudinally extending compartment 37 having a fluid inlet 38 which is in opposed relation to a continuous slot 39 that is formed in the face 40 of the nozzle confronting the traveling metal sheet 4 and is at least coextensive with the opening in the adjacent end wall of the treatment chamber 8. Any suitable means, such as conventional baffling 41 is provided within the compartment 37 of the nozzles 35,36 to uniformly distribute liquid coating solution from the inlets 38 to the slots 39.

A deflector 42 is disposed adjacent each of the slots 39 for directing a steady turbulent stream of liquid coating solution 9 angularly against the traveling metal sheet 4 such that the constant stream of liquid coating solution 9 not only contacts the traveling metal sheet 4, but creates a turbulent back flow into the treatment chamber 8 of a layer of liquid coating solution 9 of sufficient mass and velocity to stop the attempted escape of liquid coating solution 9 through the openings 13,14. The continuous back flow of liquid coating solution 9 from the sealing nozzles 35,36 moves into the critical area or space between the electrodes 15,16, to create just enough turbulence in this important area to replenish and maintain at a constant level, the concentration of the liquid coating solution 9 which becomes diluted as the coating material in the solution is drawn out of the solution and adheres to the adjacent surfaces of the traveling metal sheet 4. The deflectors 42 are designed to direct fluid coating solution 9 toward the traveling metal sheet 4 at angles substantially less than 90° relative to the plane of the metal sheet 4, e.g. less than 45° and preferably in the range of from 10°–30°. The function of the liquid seals 34 is three-fold. Firstly, they prevent the escape of liquid coating solution 9 from the apparatus 3. Secondly, they direct fresh, concentrated liquid coating solution 9 into the critical area between the electrodes 15,16 and, thirdly, they provide a liquid bed for supporting the traveling metal sheet 4 adjacent the end walls 13,14 of the chamber 8. The employment of the liquid seals 34 permits the use of larger openings through which the traveling metal sheet 4, especially the rough and ragged overlapped ends and edges of two spliced sheets of metal, can easily enter and exit the treatment chamber 8 without damaging the seals or other components of the apparatus 3.

A pair of similar, conventional blowoff nozzles 43,44 are positioned adjacent and outside the treatment chamber 8 beyond each of the liquid seals 34 to simultaneously direct converging streams of air, under pressure, angularly against the traveling metal sheet 4 in the direction of the treatment chamber 8 to aid in the prevention of the escape of liquid coating solution 9 from the apparatus 3, to provide additional fluid support for the traveling metal sheet 4 adjacent the end walls 11,12 of the treatment chamber 8, and to help minimize and control the drag-out of liquid coating material that adheres by surface tension to the metal sheet 4. As best seen in FIG. 1, the blowoff nozzles 43,44 blow off excessive, undesirable liquid coating solution 9 from the metal sheet 4 into a pair of end chambers 45,46 which are adjacent and outside the liquid seals 34, and which are in communication with similar conduits 47 for circulating the blown off liquid coating solution 9, by gravity, to the reserve chamber 10 for reuse in the coating process.

Liquid coating solution 9 is continually circulated between the upper treatment chamber 8 and the lower reserve chamber 10 by any appropriate means. For example, the reserve chamber 10 is provided with an outlet 48 adjacent the bottom 49 thereof. Piping 50 connects the outlet 48 of the reserve chamber 10 with the nozzles 35,36 of the liquid seals 34 and an inlet 51 disposed in the treatment chamber 8. A conventional pump 52 is coupled in the piping 50 and operated constantly during the coating process to continually circulate liquid coating solution 9, under pressure, from the reserve chamber 10 to the sealing nozzles 35,36 of the liquid seals 34 for passage into the treatment chamber 8. Alternately, the treatment chamber 8 can be filled with liquid coating solution 9 to the proper level by operating the pump 52 to circulate liquid coating solution 9 from the reserve chamber 10 directly to the treatment chamber 8 through the treatment chamber inlet 51 which is vertically spaced below the lowermost electrode 16. A discharge port 53 is located in the bottom 54 of the treatment chamber 8 to allow liquid coating solution 9 to flow, by gravity, from the upper treatment chamber 8 into the lower reserve chamber 10. The discharge port 53 is properly sized so that there will be a constant uniform flow of liquid coating solution 9 between the treatment chamber 8 and reserve chamber 10. A conventional overflow pipe 55 is provided adjacent the top 21 of the treatment chamber 8 to return excess liquid coating solution 9 in the treatment chamber 8 to the reserve chamber 10.

Occasionally, it becomes necessary to cool the liquid coating solution 9, since it is heated by the mechanical pumping action and electrodes 15,16 during the coating process. Accordingly, a small portion of the liquid coating solution 9 that is being continually pumped from the reserve chamber 10, is diverted, under pressure, through a conventional chilling device 56 which cools the small stream of liquid coating solution 9 sufficiently so that it can be returned to the reserve chamber 10 through an inlet 57 therein. A drain 58 is provided in the bottom 49 of the reserve chamber 10, so that the tank 6 can be readily drained of liquid coating solution 9.

It is important to continuously circulate fresh, concentrated liquid coating solution 9 to the treatment chamber 8. This is best accomplished by continuously removing liquid coating solution 9 from the reserve chamber 10 through the drain 58 and then circulating it by a pump 59 to a conventional filter or separator 60, wherein any dilutants or impurities are removed from the liquid coating solution 9 to which is then mixed fresh coating material from any suitable source 61, after which the newly improved concentrated liquid coating solution 9 is circulated back to the reserve chamber 10 through an inlet port 62.

Figure 4:
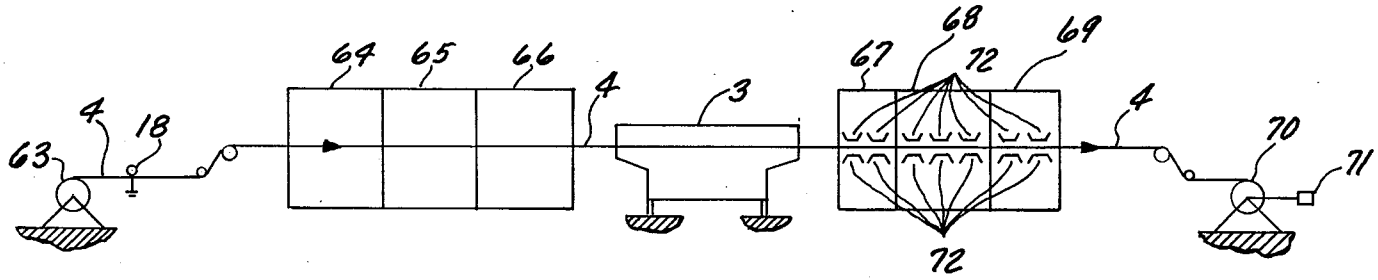
FIG. 4 is a schematic of a metal treating system employing an apparatus of the invention.

With reference to FIG. 4, the sheet 4 of metal is removed from a conventional uncoiling device 63 and successively guided through washing, rinsing and drying devices 64–66 to clean and otherwise prepare the metal sheet 4 sufficiently to receive the coating material. The metal sheet 4 then travels through the coating apparatus 3 after which it travels successively through a series of units 67–69 where the freshly coated metal sheet 4 is preheated, dried and then cooled to bake the coating material on the metal sheet 4, prior to removal to a conventional windup or coiling device 70 which is driven or rotated by any suitable drive mechanism 71 for pulling the metal sheet 4 through the various units in which the metal sheet 4 is cleaned and coated and the coating is baked thereon. The preheater 57, oven 68 and cooling unit 69 can be provided with a plurality of similar floatation nozzles 72, such as described in U.S. Pat. Nos. 3,837,551 or 3,982,327, to produce a fluid bed of air for supporting the metal sheet 4 as it travels through these particular units, as well as supplying the heated and cooled air necessary to carry out the desired processes in these particular units.

Thus, there has been described an improved electrodeposition coating apparatus which eliminates the need for any downstream rollers which have been used in the past and can damage the undried coating applied to, for example, a traveling metal sheet. Further, the main inlet through which the liquid coating solution can be continuously circulated to the bath is located vertically below the lowermost electrode, so as not to create any radical turbulence of the liquid coating solution as it travels between the electrodes. Also, unique liquid seals in combination with blow off nozzles are utilized to, (I) prevent the escape of liquid coating solution from the apparatus, (II) provide a liquid bed to support the traveling web, (III) bring fresh, highly concentrated liquid coating solution into the critical area or space between the electrodes where it is important to maintain at a constant level, the concentration of the solution which rapidly becomes diluted as coating material in the solution becomes deposited on the traveling web, and (IV) control drag-out of the liquid coating material on the web as the web exits the apparatus.

What is claimed is:

1. An apparatus in which a traveling web, such as a continuous sheet of metal, is treated, comprising:

(a) a tank having a horizontally elongated treatment chamber for holding a liquid used in the treatment of the web as it travels through the chamber, the tank having longitudinally spaced end walls with horizontally aligned openings through which the traveling web enters and exits the chamber;

(b) a liquid seal adjacent each of the openings in the end walls to prevent the escape of liquid from the chamber through the openings, each liquid seal comprising:

(I) a pair of parallel, elongated nozzles disposed normal to the direction in which the web travels, each of the nozzles having a longitudinal compartment with an inlet and at least one longitudinally extending slot facing the traveling web, the slot being at least coextensive with an adjacent opening;

(II) means for circulating liquid, under pressure, through the inlet into the compartment and uniformly out through the slot of each of the nozzles; and (III) means adjacent the slots for directing liquid, under pressure, from the slots angularly against the traveling web at an angle substantially less than 90° relative to the plane of the web, in the direction of the chamber to create a turbulent back flow of liquid of sufficient mass and velocity to, (i) block the escape of liquid through the openings, and (ii) support the traveling web adjacent the end walls.

2. The apparatus of claim 1, which includes:

(c) means disposed adjacent opposing surfaces of the traveling web and each of the liquid seals and spaced therefrom in a direction away from the chamber, for directing air, under pressure, angularly against the traveling web in the direction of the liquid seals and chamber.

3. The apparatus of claim 2, which includes:

(d) means disposed in the chamber intermediate the end walls for coating the traveling web with a coating material in the liquid, including a pair of spaced electrically changed electrodes between which the web passes as it travels through the chamber.

4. A coating apparatus, comprising in combination:

(a) a tank having a horizontally elongated treatment chamber therein, the chamber being designed to hold a liquid coating solution and having a pair of longitudinally spaced end walls with horizontally aligned openings through which a traveling web, such as a sheet of metal, enters and exits the chamber and liquid coating solution therein;

(b) a pair of electrically charged electrodes disposed longitudinally in the chamber in parallel relation to the web traveling therein and positioned relative to said openings to sandwich the traveling web therebetween;

(c) a liquid seal adjacent each of the openings through which the traveling web enters and exits the chamber, to prevent the escape of liquid coating solution from the chamber through the openings, each liquid seal including:

(I) a pair of parallel, elongated nozzles disposed normal to the direction in which the web travels, each of the nozzles having a longitudinal compartment with an inlet and at least one longitudinally extending slot facing the traveling web, the slot being at least coextensive with an adjacent opening;

(II) means for circulating liquid coating solution, under pressure, through the inlet into the compartment and uniformly out through the slot of each of the nozzles; and (III) means adjacent the slots for directing a stream of liquid coating solution, under pressure, from the slots angularly against the traveling web at an angle substantially less than 90° relative to the plane of the web, in the direction of the chamber to create a turbulent back flow of liquid coating solution of sufficient mass and velocity to, (i) block the escape of liquid coating solution through the openings (ii) support the traveling web adjacent the end walls, and (iii) bring concentrated liquid coating solution to the space between the electrodes.

5. The coating apparatus of claim 4, which includes:

(d) means other than the nozzles for directing liquid coating solution into the chamber at a level which is vertically below the electrodes to prevent in the space between the electrodes, radical turbulence which could adversely affect the coating of the web as it travels between the electrodes:

6. The coating apparatus of claim 4, which includes:

(e) means disposed adjacent opposing surfaces of the traveling web and each of the liquid seals and spaced therefrom in a direction away from the chamber, for directing air, under pressure, angularly against the traveling web in the direction of the liquid seals and chamber.

7. The coating apparatus of claim 6, which includes:

(f) a reserve chamber separate from the treatment chamber; and (g) means for capturing liquid coating solution blown from the traveling web by the air directing means (e) and circulating it to the reserve chamber for recirculation to the treatment chamber and reuse in the coating process.

8. The coating apparatus of claim 6, which includes:

(f) an edge guard at least partially covering each longitudinal marginal edge of the traveling web between the electrodes to cause more uniform coating of the traveling web laterally of the web between longitudinal marginal edges thereof, each edge guard being composed of material which is electrically nonconductive.

9. The coating apparatus of claim 8, wherein each edge guard is semi-cylindrical in configuration.

10. The coating apparatus of claim 8, wherein each edge guard is a flat strip.

11. The coating apparatus of claims 9 or 10, wherein each edge guard is composed of material of the group of polypropylene and polyvinyl chloride.

12. The coating apparatus of claim 8, which includes:

(g) means for adjusting the position of each edge guard relative to an adjacent marginal edge of the traveling web.

13. The coating apparatus of claim 4, which includes:

(f) means for removing liquid coating solution from the reserve chamber, cooling said removed solution and then returning it to the reserve chamber.

14. The coating apparatus of claim 4, which includes:

(g) means for individually adjusting the vertical position of each of the electrodes within the chamber.

15. The coating apparatus of claim 4, which includes:

(h) means for continuously removing liquid coating solution from the chamber; and (i) means for increasing the concentration of the removed solution, prior to returning it to the chamber.

16. A coating apparatus comprising:

(a) a tank having a horizontally elongated treatment chamber in juxtaposed relation to a reserve chamber, both chambers being designed to hold a liquid coating solution, the treatment chamber having a pair of longitudinally spaced end walls with horizontally aligned openings through which a traveling web, such as sheet of metal, enters and exits the chamber and liquid coating solution therein;

(b) a pair of electrically charged electrodes disposed longitudinally in the treatment chamber in parallel relation to the web traveling therein and positioned relative to the openings to sandwich the traveling web therebetween;

(c) means for individually adjusting the vertical position of each of the electrodes within the treatment chamber;

(d) an edge guard at least partially covering each longitudinal marginal edge of the traveling web between the electrodes to cause more uniform coating of the traveling web laterally of the web between longitudinal marginal edges thereof, each edge guard being composed of material which is electrically nonconductive;

(e) a liquid seal adjacent each of the openings through which the traveling web enters and exits the treatment chamber, to prevent the escape of liquid coating solution from the treatment chamber through the openings, each liquid seal including:

(I) a pair of parallel, elongated nozzles disposed normal to the direction in which the web travels, each of the nozzles having a longitudinally extending compartment with an inlet and at least one slot facing the traveling web, said slot being at least coextensive with an adjacent opening;

(II) means for circulating liquid coating solution, under pressure, through the inlet, into the compartment and uniformly out through the slot of each of the nozzles; and (III) means adjacent the slots for directing a stream of liquid coating solution from the slots angularly against the traveling web at angles substantially less than 90° to the plane of the web, in the direction of the treatment chamber to create a steady turbulent back flow of liquid coating solution of sufficient mass and velocity to (i) block the escape of liquid coating solution through the openings, (ii) support the traveling web adjacent the end walls and (iii) bring concentrated liquid coating solution to the space between the electrodes;

(f) means disposed adjacent opposing surfaces of the traveling web and each of the liquid seals and spaced therefrom in a direction away from the treatment chamber, for directing air, under pressure, angularly against the traveling web in the direction of the liquid seals and treatment chamber to help prevent the escape of liquid coating solution from the apparatus and aid in the support of the traveling web adjacent the end walls of the treatment chamber;

(g) means other than the nozzles for directing liquid coating solution into the treatment chamber at a level which is vertically below the electrodes to prevent in the space between the electrodes, radical turbulence of the liquid coating solution sufficient to adversely affect coating of the web; and (h) means for at least adjusting the position of each of the edge guards laterally of the marginal edges of the traveling web.

17. The coating apparatus of claim 16, which includes:

(i) means for continously circulating liquid coating solution between the reserve chamber and the treatment chamber;

(j) means for continuously cooling at least a portion of the liquid coating solution in the reserve chamber; and (k) means for increasing the concentration of liquid coating solution in the reserve chamber.

18. The coating apparatus of claim 17, which includes:

(l) means for preparing a traveling web for receiving a coating thereon, prior to passage through the coating apparatus; and (m) means for baking the coating on the traveling web subsequent to passage through the coating apparatus.

* * * * *